US006564934B1

(12) United States Patent
Dischler

(10) Patent No.: US 6,564,934 B1
(45) Date of Patent: May 20, 2003

(54) DISPENSER SYSTEM WITH BINARY DISPENSING ARRAY

(76) Inventor: Louis Dischler, 252 W. Park Dr., Duncan Park, Spartanburg, SC (US) 29306-5013

( * ) Notice: Subject to any disclaimer, the term of this patent is extended or adjusted under 35 U.S.C. 154(b) by 67 days.

(21) Appl. No.: 09/356,916

(22) Filed: Jul. 19, 1999

(51) Int. Cl.[7] ..... B65D 25/08
(52) U.S. Cl. ..... 206/219; 206/220
(58) Field of Search ..... 206/219, 220, 206/221, 222, 568; 215/DIG. 8

(56) References Cited

U.S. PATENT DOCUMENTS

| | | | | |
|---|---|---|---|---|
| 2,403,074 A | | 7/1946 | Goldsmith | |
| 2,605,896 A | * | 8/1952 | Rohdin | 206/219 |
| 2,768,623 A | | 10/1956 | Marchand | |
| 3,154,074 A | | 10/1964 | Harrison | |
| 3,736,933 A | | 6/1973 | Szabo | |
| 3,780,856 A | | 12/1973 | Braverman | |
| 4,111,304 A | | 9/1978 | Lucas | |
| 4,522,622 A | | 6/1985 | Peery et al. | |
| 4,785,931 A | * | 11/1988 | Weir et al. | 215/DIG. 8 |
| 5,445,195 A | * | 8/1995 | Kim | 141/104 |
| 5,522,506 A | | 6/1996 | Roulin et al. | |
| 5,529,179 A | * | 6/1996 | Hanson | 206/219 |
| 5,638,117 A | | 6/1997 | Engeldrum et al. | |
| 5,909,220 A | * | 6/1999 | Sandow | 345/431 |

* cited by examiner

*Primary Examiner*—Mickey Yu
*Assistant Examiner*—Troy Arnold

(57) ABSTRACT

The various embodiments of the invention are directed to systems for the dispensing and mixing of agents, such as paint colorants, chemicals, pharmaceuticals, or beverage additives such as sweeteners and creamers, by means of a binary array of dispensers. An array of blister dispensers is preferred.

13 Claims, 5 Drawing Sheets

FIG. 1
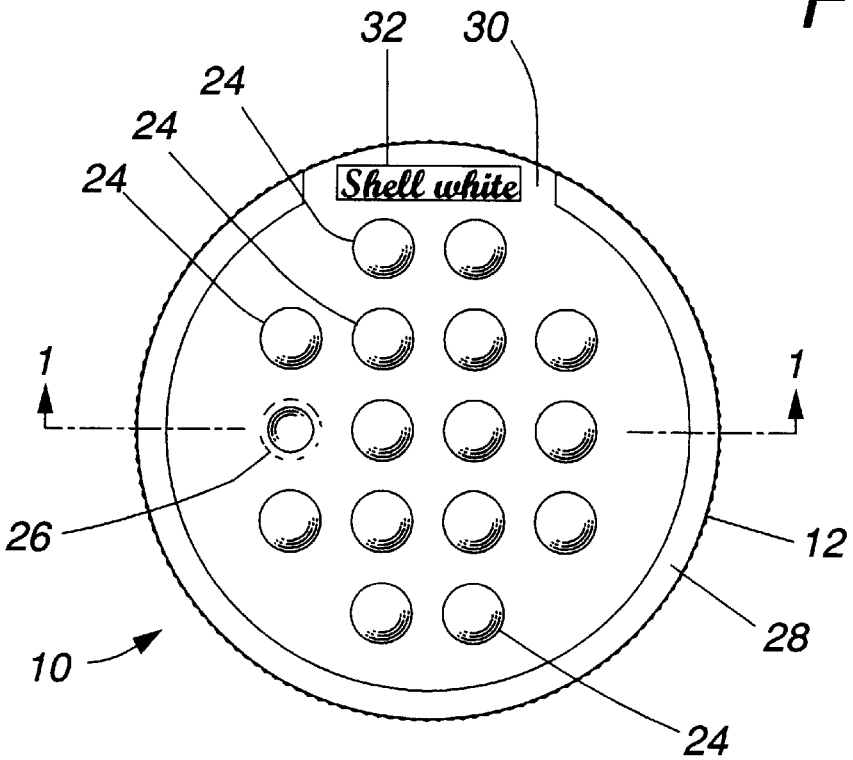
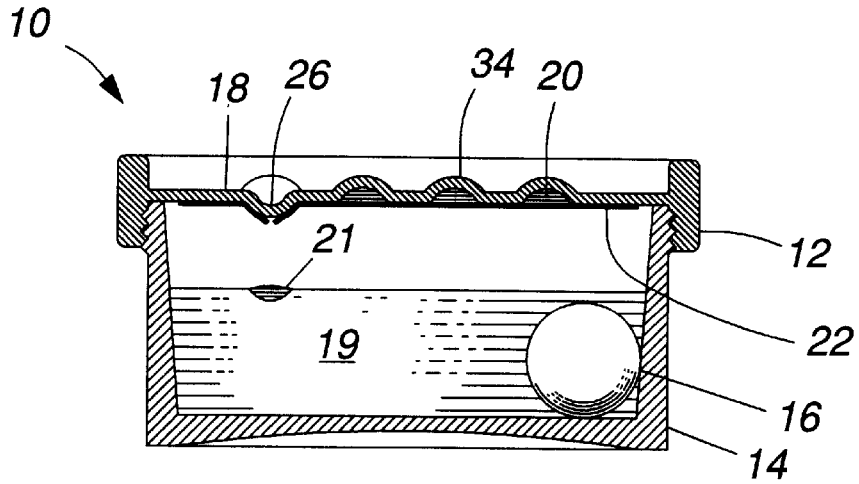
FIG. 2

DISPENSER SYSTEM WITH BINARY DISPENSING ARRAY

FIELD OF THE INVENTION

The present invention relates to a dispenser system using a binary array of dispensers, for dispensation and mixing of selected small volumes of active agents.

BACKGROUND OF THE INVENTION

There are many materials intended for home or industrial use that are not used to completion. Such materials, when containing hazardous materials such as solvents, reactive resins and the like, require special disposal treatment. A particular example of such a material is paint. Industries using such materials generally have sufficient disposal procedures in place to insure that hazardous materials such as solvent based paints do not enter landfills, but are properly disposed of. Such is generally not true for waste paint generated by home owners, model makers, and artists, where quantities of waste paint may be disposed of with other domestic wastes. Also, industrial users typically have procedures to insure the efficient utilization of paint and resins, so that waste is minimized, while for domestic users, it is often the case that a large portion of the material is wasted. This waste is due in part to the large minimum size of the cans of paint that are commercially available, especially with paints having custom colors. This is in part due to errors in color selection, and in part to poor sealing of partially used paint cans. There is therefore a need for small quantities of materials such as paints that minimize waste.

A large portion of the time invested in painting is often associated with color selection. Colors are generally selected from books containing small color chips. A visit to a paint supplier is then needed to obtain a quantity of paint mixed by the supplier to the selected color. When this paint is applied to a surface considerably larger than the color chip, it is often found that the color now seems too dark or too light, or has some other aesthetic deficiency. This results in the waste of the initial quantity of paint, at well as wasting time in obtaining more paint for a second try. Time and paint would both be saved if the painter could conveniently and accurately mix a small amount of the desired color himself, saving trips to the supplier, and minimizing wasted paint.

In mixing colorants into paints, paint suppliers must open the container to introduce colorants. Errors in dispensing of the proper dose of colorant occur, as well as spillage from improperly resealed containers. A system that introduced factory-measured doses of colorants into a sealed container would therefore be desirable.

The range of paint colors that may be selected from a chip book is necessarily small, limited by the size and cost constraints of the book. A system that would allow greater freedom of color selection to the painter while eliminating the need for chip books would be of great utility.

The prior art is replete with various types of devices for dispensing either individual doses or multiple doses of fluids or solid pellets. Representative devices are shown for example in U.S. Pat. No. 3,780,856, which discloses a square array of blister dispensers, U.S. Pat. Nos. 2,403,074, and 2,768,623, which disclose various manually operated dosage forms for dispensing an individual fluid pulse, and U.S. Pat. Nos. 3,736,933, 4,111,304 and 4,522,622 which disclose devices which can be used to dispense a multiplicity of fluid pulses, all of which are herein entirely incorporated by reference.

It is known to cover push-through forms of packaging, so called blister packs, with a layer that covers, and is sealed onto, the whole surface area and serves as the lid for the blister pack. The blister pack features one or more individual containers formed into a flexible layer, each of which holds a dose to be dispensed. These doses are most typically, shaped solid preparations or pharmaceutical products such as tablets, but may also be liquids. Generally, the material of the covering layer is of aluminum foil or a laminate of which aluminum is a component part. Aluminum foil is a preferred material for the lidding layer on blister packs as relatively little force is required to break the foil at the thickness chosen for this purpose, the energy required for this is small and the aluminum exhibits essentially no elasticity. Other friable materials may be used, especially polymeric materials containing large additions of filler as disclosed in U.S. Pat. No. 5,522,506, the teachings of which are entirely incorporated herein by reference. As a rule the flexible container portion of the blister pack is of plastic such as, e.g. PVC, polyamide, polyolefin, polyethylene-terephthalates and composites containing at least one of these materials, if desired also aluminum foil. The use of blister packs in binary arrays and the advantages accruing thereby have not previously been appreciated.

When beverages are served in disposable containers having lids, adding sweeteners and creamers and the like necessitates removal of the lid, risking spillage, a risk that is accentuated in moving vehicles. A beverage lid with built in dispensers would therefore be desirable, as mixing could then be accomplished without opening the container.

OBJECTS AND ADVANTAGES

Accordingly, I claim the following as objects and advantages of the invention: to provide a paint colorant system employing a binary array that reduces the amount of wasted paint by allowing the end user to accurately mix a small quantity paint in a wide range of potential colors.

It is another object of this invention to provide a paint colorant system which provides for the user a simple system for mixing small amounts of paint to a wide range of colors without recourse to a commercial paint distributor.

Another object of this invention is to provide a paint colorant system whereby color reference chips may be stored on a computer.

Another object of this invention is to provide a dispensing system capable of producing a large number of different dose levels.

Another object of this invention is to provide a closed mixing system that is resistant to spillage.

Another object of this invention is to provide a binary array capable of producing more dose levels than an arithmetic array.

Yet another object of this invention is to provide a convenient, spill resistant disposable beverage dispenser lid, capable of multiple dose levels.

BRIEF DESCRIPTION OF THE DRAWINGS

The above as well as other objects of the invention will become more apparent from the following detailed description of the preferred embodiment of the invention, when taken together with the accompanying drawings in which:

FIG. 1 is a top view of the lid of a binary matrix dispenser assembly according to an embodiment of the invention.

FIG. 2 is a cross-sectional view of FIG. 1 taken along line 1—1.

DRAWING REFERENCE NUMERALS

Figure 3:
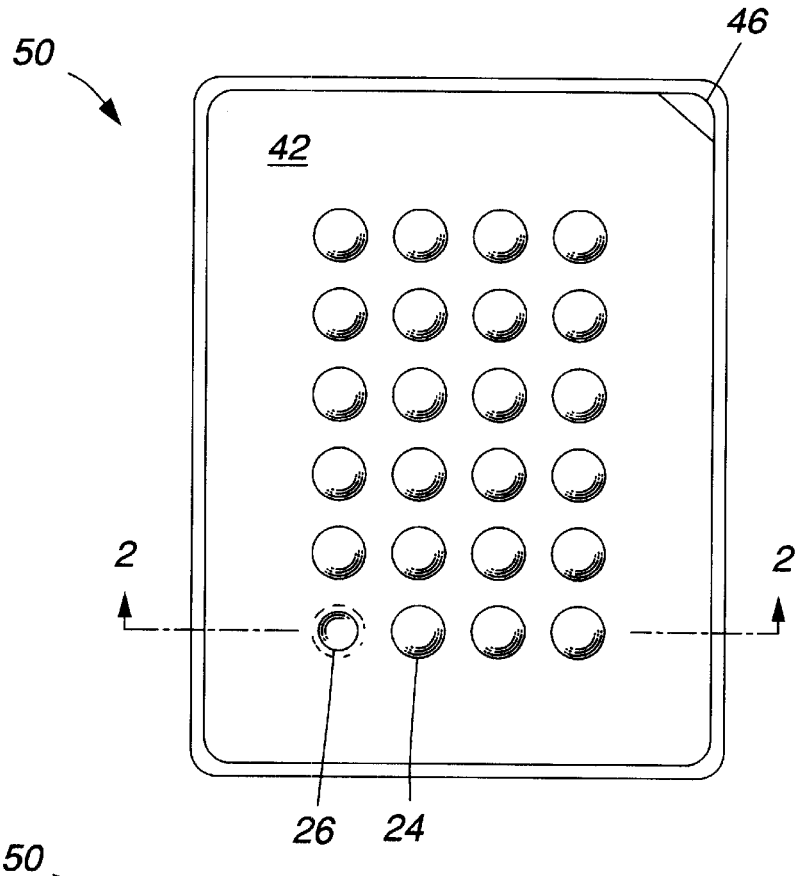
FIG. 3 is a top view of the lid of a binary matrix dispenser assembly according to an embodiment of the invention.

| | |
|---|---|
| 10 | dispenser assembly |
| 12 | lid |
| 14 | mixing container |
| 16 | mixing ball |
| 18 | recessed land |
| 19 | base |
| 20 | active agent |
| 21 | dispensed active agent |
| 22 | friable barrier |
| 24 | blister dispenser |
| 26 | activated dispenser |
| 28 | rim |
| 30 | registration key |
| 32 | legend |
| 34 | flexible barrier |
| 42 | lid |
| 44 | mixing container |
| 46 | tab |
| 49 | cover |
| 50 | dispenser assembly |
| 51 | dispenser assembly |
| 52 | piston |
| 53 | cylinder |
| 54 | orifice |
| 55 | active agent |
| 56 | friable layer |
| 57 | dispensed active agent |
| 58 | lid |
| 60 | dispenser assembly |
| 61 | hole |
| 62 | color chip |
| 63 | blister dispenser |
| 64 | chip book |
| 65 | tongue |
| 66 | mounting hole |
| 67 | body |
| 68 | screw |
| 69 | activated blister dispenser |
| 70 | color chip card |
| 71 | color chip |
| 72 | color chip |
| 73 | color chip |
| 74 | color chip |
| 75 | color chip |
| 76 | color chip |
| 81 | pictogram |
| 82 | pictogram |
| 83 | pictogram |
| 84 | pictogram |
| 85 | pictogram |
| 86 | pictogram |
| 88 | filled circle |
| 90 | open circle |
| 92 | mounting hole |

-continued

| | |
|---|---|
| 100 | beverage lid |
| 102 | creamer blister |
| 103 | sugar blister |
| 104 | saccharin blister |
| 105 | saccharin blister |
| 106 | aspartame blister |
| 107 | aspartame blister |
| 108 | cross-cut |
| 110 | cup |
| 112 | beverage |

SUMMARY OF THE INVENTION

Specific terms are used as follows: the term "active agent" is herein defined to mean the material to be dispensed that imparts some desired primary functionality to the mix. For example, in a color matching system for paint, this active agent could be a colorant. In an epoxy system, the active agent could be a reactive cross-linker. In a pharmaceutical system, the active agent could be a drug, or a material that interacts with a drug so as to limit or enhance the potency. In a cup of coffee, the active agent could be a sweetener or creamer. "Active agent dose" means the total mass of the material to be dispensed, less the mass of any inactive agent. "Inactive agent" means any agent that does not materially impact the primary functionality. In a colorant system, an inactive agent would be a dilutant such as water or other solvent, or other materials that do not substantially contribute to the final shade of the paint. In a chemical or pharmaceutical system, the inactive agent would be chemically or pharmaceutically inactive, but could have secondary characteristics; for example, a useful secondary characteristic might be a color that serves as a visual indicator of the strength of the chemical or pharmaceutical agent. "Dispensing container" means a discrete container from which is delivered a single active agent dose. "Mixing container" means the larger container into which individual doses are dispensed and thereafter mixed. The mixing container might also contain a base substance, such as a paint base into which colorants are added. "Binary dispensing array" means at least one row of at least two dispensing containers charged with the same active agent, where the ratio of active agent dose in at least one dispensing container to that of at least one other dispensing container is approximately two.

Any method of achieving this active agent ratio may be used. For example, the containers may be volumetrically equal, but the active agent of one may be diluted by a factor of two as compared to another. Or, the active agent may be of uniform concentration, but the volume of the active agent in one container may vary by a factor of two from that contained within another. This may be achieved by varying the size of the container appropriately, or by partial filling. Obviously, combinations of any of these methods may also be used. But it is preferred that the blisters within a single binary array be all of the same size, and the dose within blisters be varied by dilution. This insures that the mechanical action is uniform across the binary array, and the same pressure is developed relatively consistently to rupture the friable layer.

Any agent normally used to effect the properties of paint may also be used as an active agent, either alone or in conjunction with colorants. For instance, the drying time, the surface sheen, the fluidity may all be modified to the desired degree by the use of binary arrays of dryers, surface active agents, viscosity modifiers, and the like.

While blister dispensers are preferable as dispensing containers for forming a binary dispensing array, other means may be used. For instance, a binary dispensing array with syringes as the dispensing containers may be employed.

One of the advantages of the binary dispensing array is the relatively large number of uniformly spaced doses that may be generated. To appreciate this, it is useful to compare the binary dispensing array of the instant invention to an "arithmetic dispenser array", which is herein taken to mean an array of dispensers where each dispenser contains an equal amount of active agent. In the degenerate case, an arithmetic array contains only one dispenser. With one blister dispenser containing a unit dose of active agent, only two dosage levels are available, i.e., no dose and one unit dose. Adding a second blister dispenser also containing a unit dose, there are three dosage levels available, zero, one and two units. For an array of n blister dispensers, each containing an equal unit dose of active agent, the total number of available dosage levels increases arithmetically, and is equal to n+1, with an increment between dosage levels equal to one unit dose. In contrast, for a binary dispensing array according to the instant invention, where the first blister dispenser contains a unit dose of active agent, the second contains two unit doses, the third containing four unit doses, the fourth containing eight unit doses, and so on, to the nth dose $2^{n-1}$ unit doses, the total number of available-dosage levels increases geometrically. For a binary dispensing array of n blister dispensers, the total number of dosage levels achievable by the combinational activation of dispensers is equal to $2^n$, with an increment between dosage levels equal to one unit dose. $2^n$ is greater than n+1 for all n>1, therefore, for a blister array containing two or more binary blister dispensers, the instant invention has the advantage of providing more dosage levels than an array of blister dispensers where all the dispensers contain equal doses. This advantage may be very large for small n. For example, for an array of 5 binary blister dispensers, the instant invention provides 32 dose levels (zero through 31), as compared to 6 (zero through 5) for an arithmetic array. For 25 binary blister dispensers, a binary array of dispensers provides more than 33 million evenly spaced dose levels, as compared to 26 evenly spaced dose levels for an arithmetic array of dispensers having equal doses. For a colorant dispenser array containing 5 colors, with a binary array of 5 binary blister dispensers for each color, for a total of 25 blister dispensers, 32 levels of each single color may be selected. With all possible combinations of all 5 colors, there are a total of $32^5$ levels, representing more than 33 million different colors that may be generated.

While it is usual to employ a mixing container with a liquid base substance into which the active agents are dispensed and mixed, this is not always the case. As an example, the instant invention may be employed with active agent doses of fragrances to create a sampler. Selected doses may then be allowed to volatilize and thoroughly mix in the air of the mixing container before opening and sampling, so that millions of different potential combinations may be contained within a single binary array, using a minimum amount of fragrance, and eliminating the need for a alcohol carrier.

It should be apparent that the shape of the dispenser as well as the pattern of the orientation of the blisters can be varied to adapt the device for any particular end use or target customer group. Also, the individual doses within the array need not be arranged in any particular order, as long as the order chosen is consistent.

A binary array may have the potential of producing millions of distinct colors, but this capability cannot be fully utilized without a color reference for each to indicate to the user what color or shade of color may be achieved. References are typically printed in the form of color chips along with a numerical code to indicate the identities and quantities of colorants to be added to a base. A number of color chips may be bound into a book. Such a book may be used with the instant invention; however, the physical size of such books limits the number of colors that can be represented to several hundred, while the small size of the chips limits the accuracy in judging how a given color will look on an extended surface. With the instant invention it is possible to generate all or most of the possible colors on a computer display screen, along with a pictogram or other means of indicating to the user which elements of the binary array are to be used to achieve the displayed color. Such displayed information may be made conveniently available to the user by means of an Internet link. Colors may be displayed full screen, if desired, in order that the user may better gauge the appearance of an extended surface, and may be displayed with selected complementary or trim colors. A portable computer is preferred for this use. Further, the displayed colors can be customized to the lighting conditions of the user, so as to best represent the appearance of the colors under fluorescent, natural, or incandescent lighting, or combinations thereof. The accuracy of color rendition on the user's screen may be further enhanced by physically mixing a color, painting a surface to provide a color card, and interactively matching the resultant color to a screen color. If a transparent container is used, the color may even be viewed through the container, without the need for painting a color card. Obviously, several colors may be matched in a sequence from lightest to darkest without ever opening the container. Having matched one or more colors, the values of the displayed colors may be altered to compensate for color inaccuracies of the user's video display, and for ambient lighting. One or more color chips may be provided with the dispenser so that a color card need not be prepared by the user. One method of interactively matching a display to a color card suitable for use with the instant invention is disclosed in U.S. Pat. No. 5,638,1.17, the teachings of which are entirely incorporated herein by reference.

In the case of disposable dispensing lids for beverages, a binary dispenser for such additives as sweeteners, lemon flavoring, creamers and the like, is also useful; however, an additive array is often sufficient, as the number of doses taken of sweeteners and creamers is traditionally only one or two for most people. In either case, such as dispenser allows the addition of these additives without the necessity of removing the lid from a container holding the beverage, thereby reducing the possibility of spillage. Incorporating the dispenser in the lid also eliminates the possibility of forgetting to obtain these additives.

While reference has been made above to incorporation of a dispensing array into a lid, it is obvious that the dispensing array may also be incorporated into a container.

DESCRIPTION OF THE INVENTION

A manually operated binary dispensing assembly according to an embodiment of the instant invention is shown generally as numeral 10 in FIGS. 1 and 2. Dispenser assembly 10 comprises a lid 12 provided with a multiplicity of blister dispensers 24. Pressing down on blister dispenser 24 with a finger, pencil, or other object, increases the pressure in the active agent 20 and results in the rupture of the friable layer 22 and expulsion of active agent 20. It is preferred that the flexible barrier 34 of the activated dispenser 26 invert when actuated, in order to more completely dispense the active agent 21, and to indicate to the user that the dispenser has operated correctly. Flexible barrier 34 comprising the upper part of blister dispenser 24 may be made from any of a wide variety of materials known in the art for use in blister packaging. These materials are impermeable to the fluid contained within the dispenser and sufficiently flexible to be deformed from the initial convex configuration to the final concave configuration without breaking, while being of sufficient stiffness to resist returning to the original configuration after the pressure of operation is removed. Suitable materials well known to those knowledgeable in the field include polyvinyl chloride, polyolefin and polyester resins. Typical blister films are approximately 10 mils in thickness.

Dispensed active agent 21 is ejected into mixing container 14, where it may be mixed into the base 19 by shaking. The mixing action may be enhanced by the free movement of a mixing ball 16 included in mixing container 14.

Lid 12 comprises a rim 28 surrounding a recessed land 18 of a flexible barrier 34, into which raised blister dispensers 24 are embossed. Friable layer 22 is sealed to the lower surface of lid 12, forming a reservoir of predetermined fluid volume for active agent 20. Lid 12 and friable barrier 22 are bonded to each other substantially across their contacting faces by adhesive or solvent bonding or any other suitable means to provide a fluid tight seal.

Lid 12 comprises space for a legend 32, for reference by the user, and a registration key 30, so that the array of blister dispensers may be correctly oriented. While lid 12 is threadably attached to mixing container 14, so that the mixed material may be used over a period of time, mixing of the material is entirely accomplished without the need for removal of lid 12.

Figure 4:
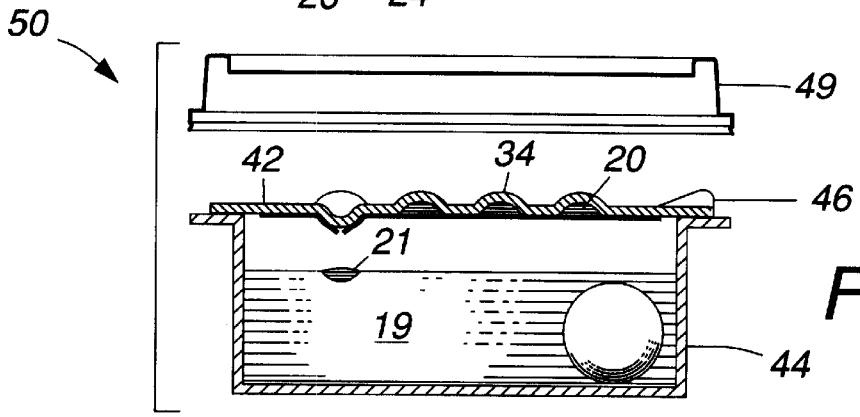
FIG. 4 is a cross-sectional view of FIG. 3 taken along line 2—2.

In FIGS. 3 and 4, a rectangular dispensing assembly according to another embodiment of the instant invention is generally indicated by the numeral 50. Dispenser assembly 50 comprises a lid 42 that is sealed to a rectangular mixing container 44. After actuation of one or more selected blisters 26 and subsequent mixing of the dispensed active agent into base 19, lid 42 is stripped away by pulling the tap 46. An optional removable cover 49 protects blister dispensers 24 from accidental operation, and extends the pot life of mixed base 19 and dispensed active agent 21 once lid 42 is removed. For paint, it is preferred that lid 42 be of a transparent polymeric material such as acrylic, polyvinyl chloride, polyethylene, polypropylene, polycarbonate or like material, so that the color of the mixed material may be observed.

Figure 5:
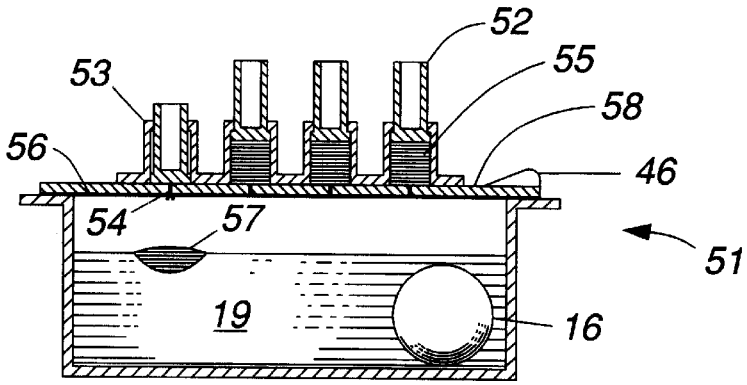
FIG. 5 is a cross-sectional view of FIG. 3 taken along line 2—2, with the addition of an optional cover.

In FIG. 5, a dispensing assembly according to another embodiment of the instant invention is generally indicated by the numeral 51. In this case, the dispensing array comprises an array of syringes. A dose of active agent 55 contained in the cylinder 53 is bounded by a piston 52 and by the lid 58. The orifice 54 penetrates through lid 58. A friable layer 56 is bonded to the lower side of lid 58. Pressure on piston 52 ruptures friable layer 56 and ejects the active agent 57 into base 19 to be mixed.

Figure 6:
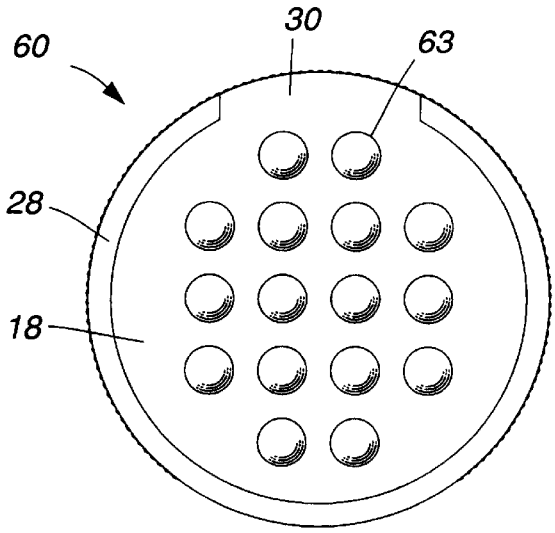
FIG. 6 is a top view of the lid of a binary matrix dispenser assembly according to an embodiment of the invention.
Figure 7:
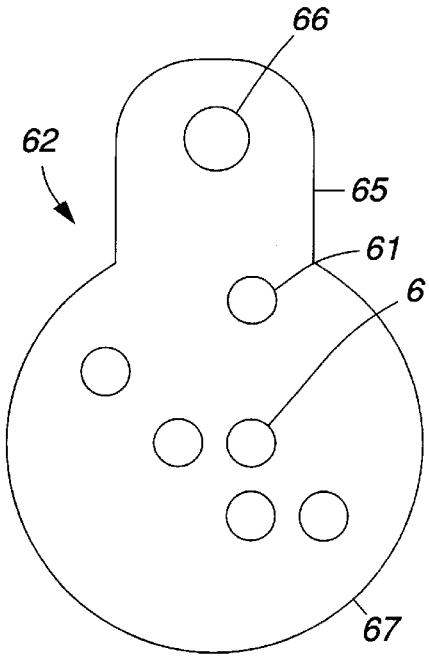
FIG. 7 is a top view of a color chip.
Figure 8:
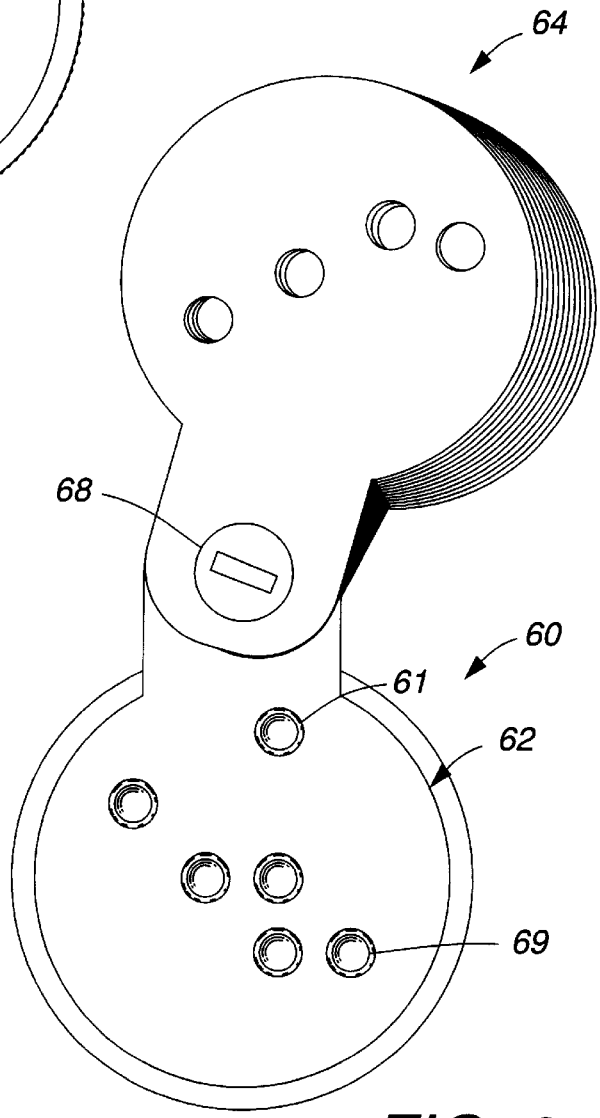
FIG. 8 is a top view of a color chip book, with one chip fitted to the lid of FIG. 6.

In FIG. 6, the top of a dispensing assembly comprising an array of blister dispensers 63 is generally indicated by the numeral 60. The rim 28 is interrupted to provide a registration key 30, which is level with recessed land 18. In FIG. 7, a color chip that is generally indicated by the numeral 62 comprises a tongue 65 which fits into registration key 30 of dispenser assembly 60, and a body 67 which fits into the recessed land 18. The holes 61 punched in body 67 of color chip 62 indicate which of blister dispensers 63 are to be actuated in dispenser assembly 60. A mounting hole 66 in color chip 62 allows multiple color chips to be bound together into a book. In FIG. 8, a chip book is generally indicated by numeral 64. The screw 68 bounds the individual color chips together. Individual color chip 62 is shown placed on dispenser assembly 60, indicating to the user which dispensers to activate. The activated blister dispensers 69 are visible through holes 61.

Figure 9:
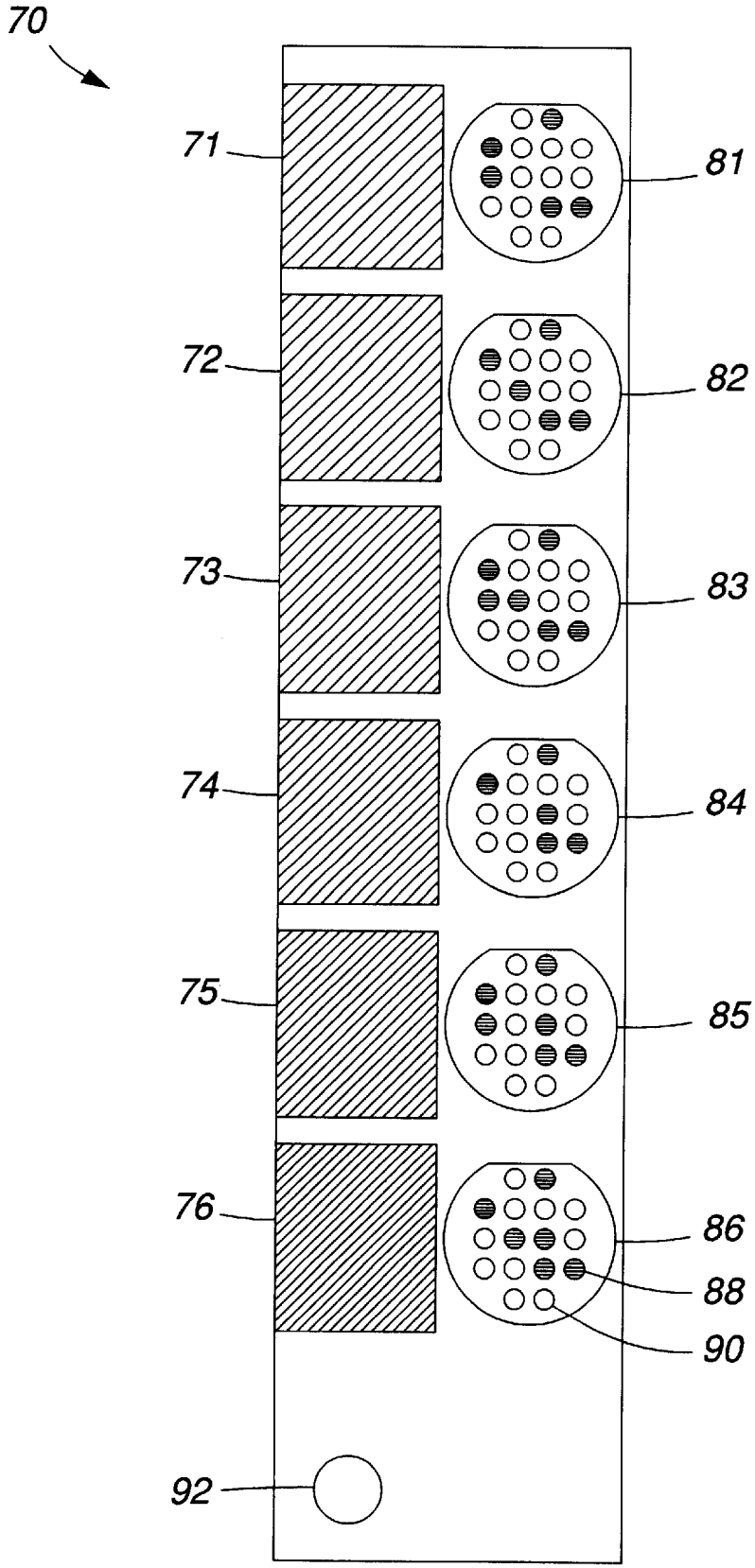
FIG. 9 is a top view of a color chip card.

In FIG. 9, a color chip card is generally indicated by the numeral 70. A number of color chips 71–76 are printed on the card along with associated pictograms 81–86. Pictograms 81–86 graphically represent the top of a binary array, showing by means of a filled circle 88 that a given blister dispenser is to be pressed, and by means of a open circle 90 that a given blister dispenser is not to be pressed. A mounting hole 92 is provided for binding chip card 70 into a chip card book (not shown).

Figure 10:
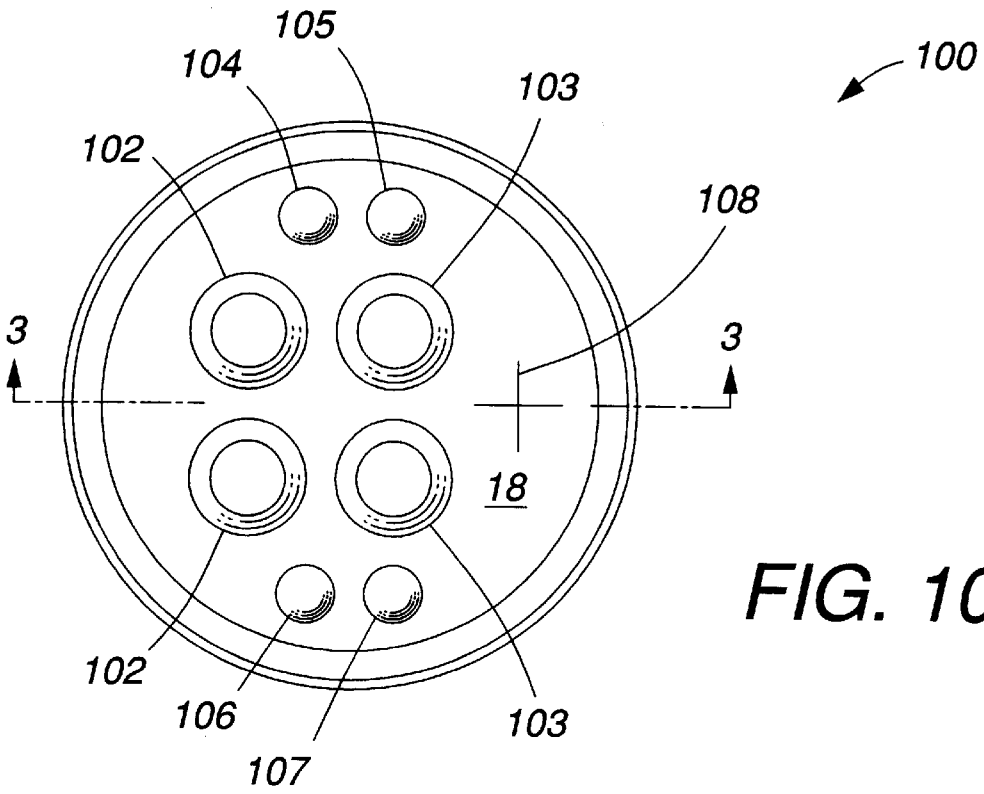
FIG. 10 is a top view of a matrix dispenser lid according to an embodiment of the invention.
Figure 11:
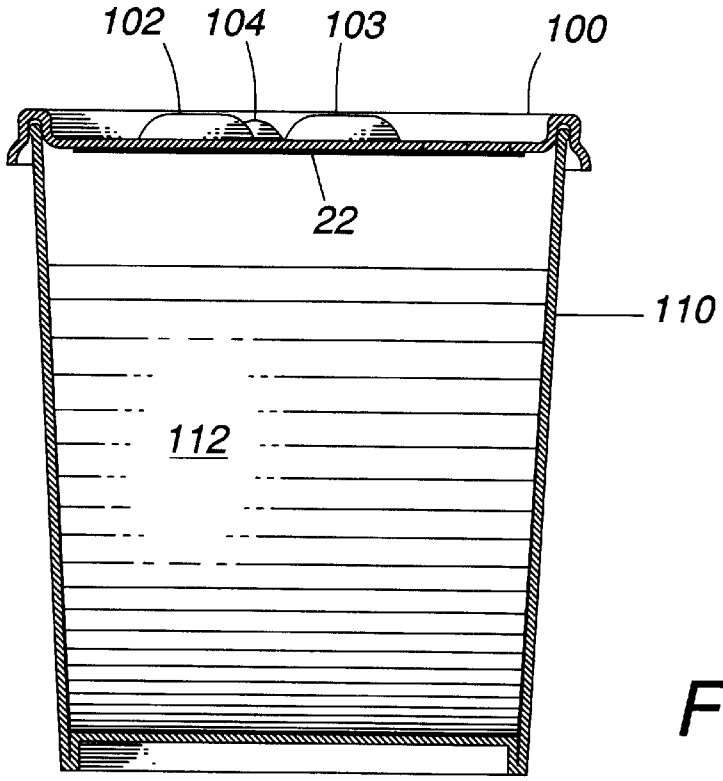
FIG. 11 is a cross-sectional view of FIG. 10 taken along line 3—3.

In FIG. 10, the top of a beverage lid is generally indicated by the numeral 100. Incorporated into lid 100 are saccharin blisters 104, 105, and aspartame blisters 106, 107. Somewhat larger are the creamer dispensers 102 and the sugar dispensers 103. A crosscut 108 penetrates the recessed land 18, but not the friable barrier 22 (shown in FIG. 11). This prevents the possibility of spillage until a straw (not shown) is forced through cross-cut 108, breaking friable layer 22. In FIG. 11, lid 100 is shown attached to a cup 110 that contains a beverage 112.

While the invention has been described in connection with preferred embodiments, it is not intended to limit the scope of the invention to the particular form set forth, but on the contrary, it is intended to cover such alternatives, modifications, and equivalents as may be included within the spirit and scope of the invention as defined by the appended claims.

I claim:

1. A dispenser system comprising at least one binary dispensing arrays said binary dispenser array comprising a first, second . . . Nth dispensers, said dispensers charged with individual doses, said doses comprising an active agent, said active agent present in said first dispenser in a first dose amount, and said second . . . Nth dispensers comprising said active agent in an amount approximately equal to 2, . . . $2^{N-1}$ times said first dose amount, respectively, whereby the maximum number of uniformly spaced dose levels of said active agent may be achieved by the combinational activation of said dispenser.

2. A dispenser system as recited in claim 1 wherein said dispensers are comprised of blister dispensers, each of said blister dispensers comprising an upper raised flexible barrier, and a lower friable barrier bonded to said upper raised flexible barrier, whereby a volume is formed therebetween.

3. A dispenser system as recited in claim 2 wherein said blister dispensers are charged with active agent doses of colorant.

4. A dispenser system as recited in claim 1, further comprising:

(a) a lid containing said binary dispensing array; and (b) a mixing container sealaby engageable to said lid.

5. A dispenser system as recited in claim 1, further comprising:

(a) a mixing container containing said at least one binary dispensing array; and (b) a lid sealably engageable to said mixing container.

6. A dispenser system as recited in claim 3, further comprising:

(a) a plurality of color chips; and (b) a reference code associated with each said color chip, to indicate which of said blister dispensers are to be actuated to match said color chip.

7. A colorant dispenser system as recited in claim 6, where said reference code comprises a pictogram to visually indicate which of said blister dispensers contained within said array of blister dispensers are to be actuated to match said color chip.

8. A colorant dispenser system as recited in claim 6, wherein said color chips are stored on a computer and are viewable on a color monitor.

9. A colorant dispenser system as recited in claim 8, wherein said color chips stored on said computer are accessible via an Internet link.

10. A dispenser system comprising at least one binary dispensing array, said binary dispensing array comprising:

a first dispenser comprising a first dose, and no other dose; and a second dispenser comprising a second dose, and no other dose;

wherein activation of said first dispenser dispenses substantially all of said first dose;

wherein activation of said second dispenser dispenses substantially all of said second dose;

wherein said second dispenser is fixedly attached to said first dispenser;

wherein said first dose comprises a first amount of an active agent;

wherein said second dose comprises a second amount of said active agent;

wherein said second amount of said active agent is approximately equal to twice said first amount of said active agent; and wherein dispensation of four substantially uniformly spaced amounts of said active agent may be achieved by the combinational activation of only said first dispenser and said second dispenser.

11. A dispenser system as recited in claim 10, wherein said active agent is a colorant.

12. A dispenser system as recited in claim 10, wherein said first dispenser and said second dispenser each comprise an upper raised flexible barrier and a lower friable barrier bonded to said upper raised flexible barrier, whereby a volume for containment of said active agent is formed therebetween.

13. A dispenser system as recited in claim 12, wherein said active agent is a colorant.

* * * * *